US007011000B2

(12) United States Patent
Kushida et al.

(10) Patent No.: US 7,011,000 B2
(45) Date of Patent: Mar. 14, 2006

(54) BOLT OR NUT TIGHTENING DEVICE HAVING REACTION FORCE RECEIVING MEMBER

(75) Inventors: Toshihiko Kushida, Osaka (JP); Yukio Torigai, Sakai (JP)

(73) Assignee: Maeda Metal Industries, Ltd., Osaka (JP)

( * ) Notice: Subject to any disclaimer, the term of this patent is extended or adjusted under 35 U.S.C. 154(b) by 0 days.

(21) Appl. No.: 11/156,803

(22) Filed: Jun. 20, 2005

(65) Prior Publication Data

US 2005/0279198 A1 Dec. 22, 2005

(30) Foreign Application Priority Data

Jun. 21, 2004 (JP) ..... 2004-181994

(51) Int. Cl.
*B25B 23/151* (2006.01)

(52) U.S. Cl. ..... 81/302; 81/57.11; 81/57.13; 81/467

(58) Field of Classification Search ..... 81/57.11, 81/57.13, 57.39, 467, 469, 302

See application file for complete search history.

(56) References Cited

U.S. PATENT DOCUMENTS

| | | | | | |
|---|---|---|---|---|---|
| 4,155,278 | A | * | 5/1979 | Estok | 81/57.11 |
| D360,568 | S | * | 7/1995 | Fukuhara et al. | D8/69 |
| 5,490,439 | A | * | 2/1996 | Matsumura et al. | 81/469 |
| 5,513,546 | A | * | 5/1996 | Ikeda et al. | 81/57.13 |
| 5,816,121 | A | * | 10/1998 | Yoshimizu et al. | 81/469 |
| 6,053,080 | A | * | 4/2000 | Kaneyama et al. | 81/469 |

* cited by examiner

*Primary Examiner*—Lee D. Wilson
*Assistant Examiner*—Anthony Ojini
(74) *Attorney, Agent, or Firm*—Arnold B. Silverman; Eckert Seamans Cherin & Mellott, LLC

(57) ABSTRACT

A bolt or nut tightening device comprising a tightening socket (4) and a reaction force receiving member (5), the tightening socket (4) being rotatingly drivable upon a speed reduction by a motor (2) and a reduction mechanism (3) which are incorporated in the device, the motor (2) being coupled to a controller (7), the controller (7) being operable to deenergize the motor (2) in response to a tightening completion signal of detecting means (70) for detecting the completion of tightening of a bolt or nut and to reversely rotate the motor (2) only for a moment upon lapse of a predetermined period of time taken for inertial rotation of the motor (2) to reduce to an extent neglectable for the reverse rotation of the motor (2) after the deenergization, whereby the propping action of the reaction force receiving member (5) is nullified.

8 Claims, 7 Drawing Sheets

BOLT OR NUT TIGHTENING DEVICE HAVING REACTION FORCE RECEIVING MEMBER

FIELD OF THE INVENTION

The present invention relates to bolt or nut tightening devices having a reaction force receiving member.

BACKGROUND ART

The present applicant has provided several kinds of bolt or nut tightening devices comprising a tightening socket and a reaction force receiving member, the socket being rotatingly drivable by a motor and reduction means which are incorporated in the device (see, for example, JP-A No. 7-88777 and JP-A No. 8-197345).

With these tightening devices, the reaction force receiving member is brought into contact with a nut or like projection positioned in the vicinity of the nut to be tightened up for the projection to receive the reaction force of tightening.

Conventional tightening devices having a reaction force receiving member are used for bolts and nuts having a large nominal diameter, and the devices are large-sized.

Bolt and nuts having a small nominal diameter can be tightened up at a high speed by impact wrenches, which are therefore efficient to use. However, impact wrenches have the problem of releasing a loud noise during operation and impairing the work environment.

Accordingly, the applicant has made efforts to develop compact tightening devices having a reaction force receiving member for use with bolts and nuts of small nominal diameter, whereas provision of small tightening devices encounters the following problem.

When a nut is completely tightened up by the tightening device having a reaction force receiving member, the receiving member, as positioned between the tightened-up nut and a projection receiving the reaction force, performs a propping action with a great force in the direction of rotation of the tightening socket, and the device including the reaction force receiving member elastically deforms although slightly, regardless of whether the device is large-sized or small. Further even if the motor is deenergized after the completion of tightening, the motor rotates through inertia, exerting a force to hold the device elastically deformed.

The large tightening device has high rigidity in its entirety including the reaction force receiving member and therefore elastically restores itself effectively. Accordingly, if the motor is deenergized after the completion of tightening, the tightening device including the reaction force receiving member elastically restores itself, and the propping action of the receiving member as positioned between the tightened-up nut and the projection will be nullified automatically. Consequently, the tightening socket is smoothly removable from the nut.

However, small tightening devices are smaller than large tightening devices in rigidity and therefore restore themselves less effectively. Even if the motor is deenergized after the completion of tightening, therefore, the tightening device including the reaction force receiving member remains elastically deformed. Since the reaction force receiving member remains propping toward the direction of rotation as positioned between the tightened-up nut and the projection, great resistance acts against the removal of the tightening socket from the nut.

For this reason, the device can not be removed from the bolt and nut even if pulled straight axially of the bolt and nut.

The tightening device must be forcibly removed, as inclined with respect to the axis of the bolt and nut, from the bolt and nut.

With tightening devices having a reversely rotating function (loosening function), a forward-reverse changeover switch is manipulated for the motor, and the operation switch (trigger) is then pulled to reversely rotate the motor for a short period of time to nullify the propping action of the reaction force receiving member.

The former case requires labor and is inefficient.

In the latter case, the motor needs to be reversely rotated only for a moment to free the tightening device from elastic deformation, whereas it is difficult to properly pull the operation switch, with the result that the motor is likely to be reversely rotated to such an extent as to loosen the nut. Furthermore, it is necessary to manipulate the forward-reverse changeover switch first and then the operation switch, hence a cumbersome and inefficient procedure. In either case, such devices are not actually usable for tightening up many bolts and nuts at the site of construction.

An object of the present invention is to a small-sized tightening device which has a tightening socket and a reaction force receiving member, the socket being readily removable from the bolt or nut as completely tightened up although the device is compacted.

SUMMARY OF THE INVENTION

The present invention provides a device for tightening a bolt or a nut and comprising a tightening socket and a reaction force receiving member, the tightening socket being rotatingly drivable upon a speed reduction by a motor and a reduction mechanism which are incorporated in the device, the motor being coupled to a controller, the controller being operable to deenergize the motor in response to a tightening completion signal of detecting means for detecting the completion of tightening of a bolt or nut and to reversely rotate the motor only for a moment upon lapse of a predetermined period of time taken for inertial rotation of the motor to reduce to an extent neglectable for the reverse rotation of the motor after the deenergization.

When the bolt or nut is completely tightened up, the motor is automatically rotated reversely, so that the reaction force receiving member is released from a propping action, and the tightening socket can be removed from the bolt or nut easily.

The motor is reversely rotated with a slight time delay after the deenergization of the motor, that is, the motor is reversely rotated after the motor in inertial rotation is slowed down or after the motor is brought out of inertial rotation. This lessens the load on the motor and on the controller, preventing these components from damage.

Because the motor is reversely rotated only for a moment, it is unlikely that the bolt or nut will be loosened to such an extent that retightening is required.

The bolt or nut is tightened and the motor is reversely rotated for a moment, with the operation switch (trigger) pulled, so that there is no need for a cumbersome manual procedure for changing over a switch, with the result that many bolts and nuts can be tightened up with a very high efficiency.

DETAILED DESCRIPTION OF THE INVENTION

A description will be given below of hand-held bolt-nut tightening devices having a battery installed therein and embodying the present invention.

Figure 1:
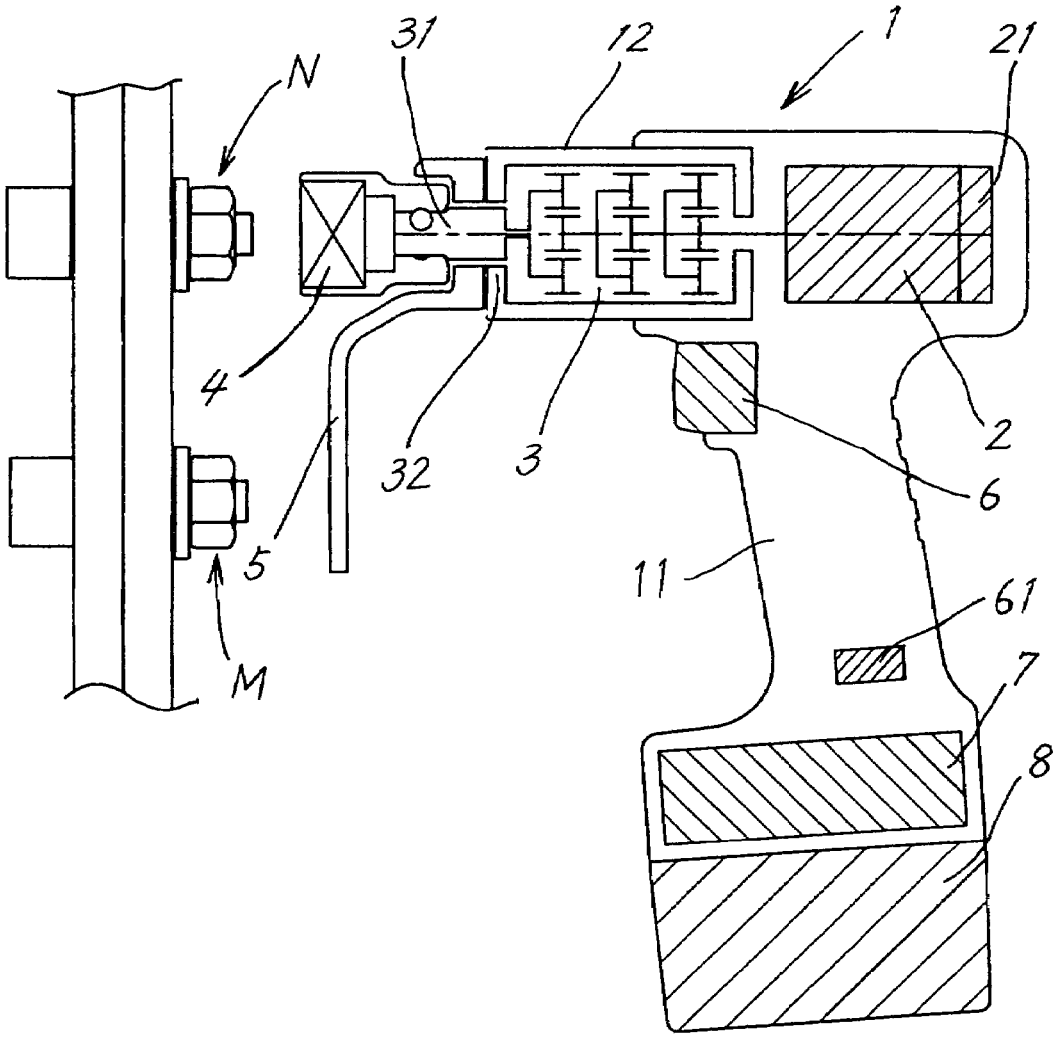
FIG. 1 is a schematic view in vertical section of a bolt or nut tightening device.
Figure 2:
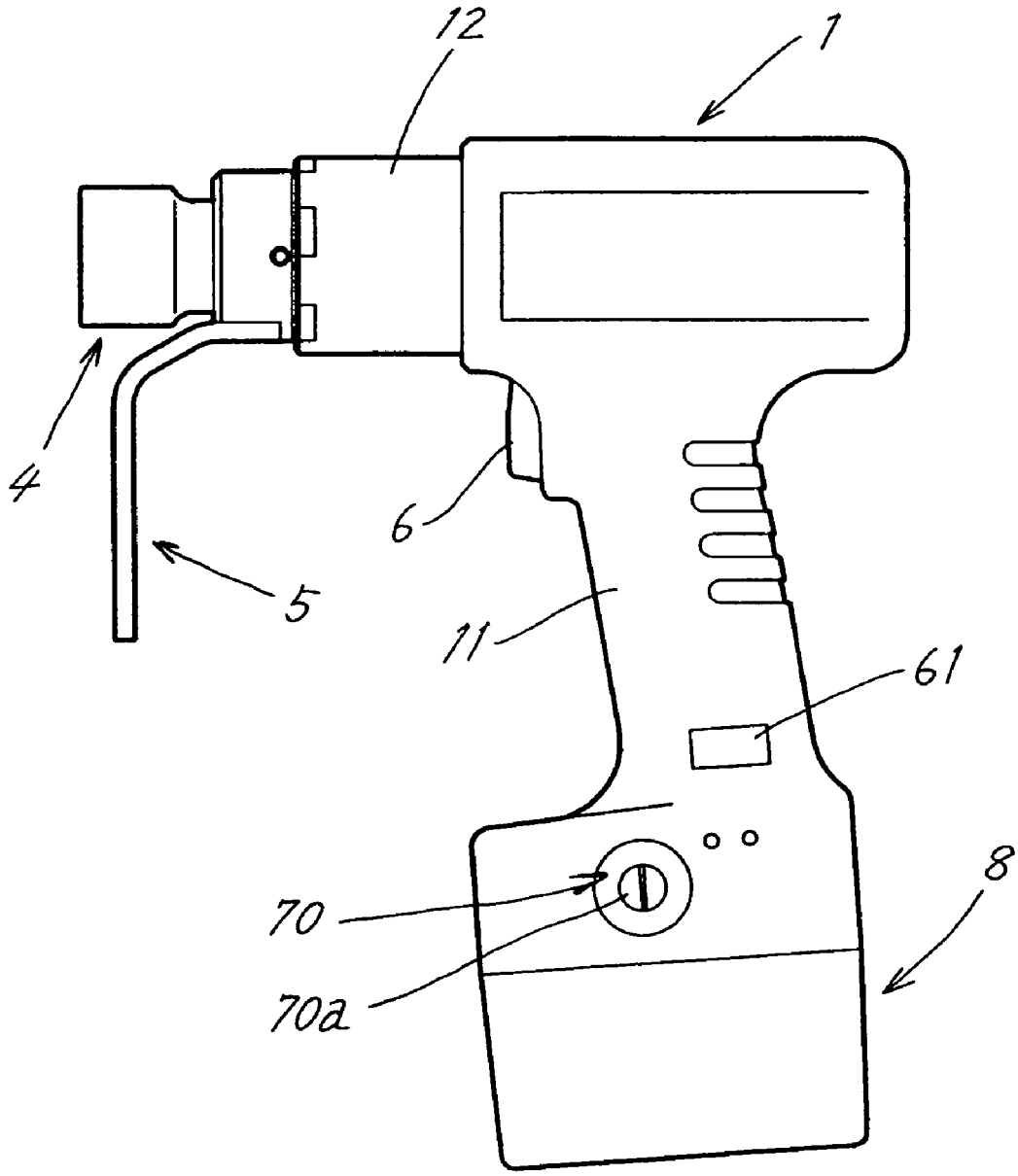
FIG. 2 is a front view of the bolt or nut tightening device.
Figure 3:
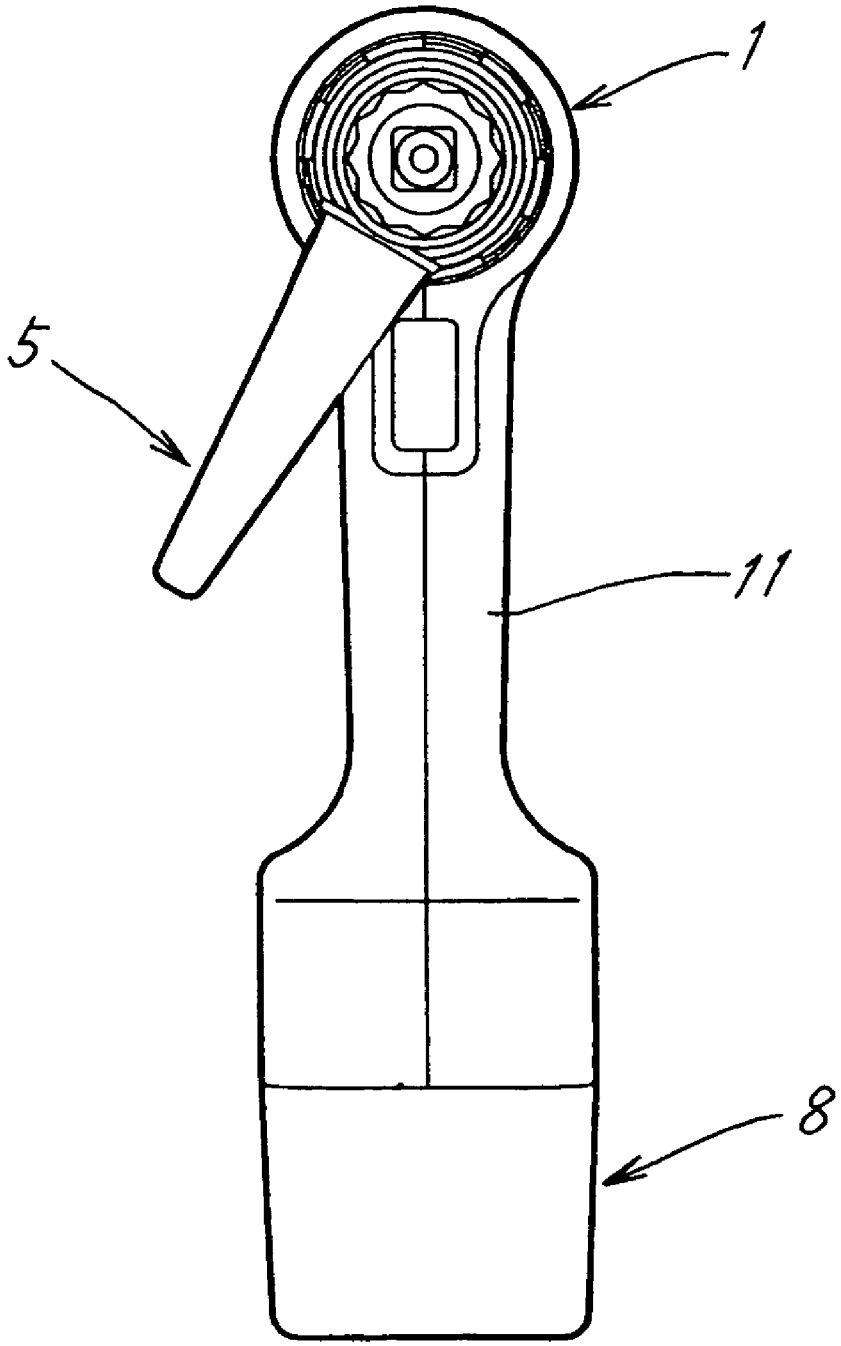
FIG. 3 is a left side elevation of the bolt or nut tightening device.

FIG. 1 shows a bolt or nut tightening device which comprises a motor 2 provided in a rear portion of a casing 1, a planetary gear reduction mechanism 3 housed in a front tubular portion 12 of the casing and operable by the motor 2, and a handle 11 extending downward from the casing rear portion.

A rechargeable battery 8 is removably installed in the lower end of the handle 11.

An output shaft 31 and a reaction force receiving shaft 32 are coaxially coupled to the planetary gear reduction mechanism 3 so as to be rotatable in opposite directions to each other. The two shafts 31, 32 project forward from the forward end of the casing front tubular portion 12. The output shaft 31 has removably connected thereto a tightening socket 4 engageable with the head of a bolt or a nut (hereinafter referred to typically as a "nut N"). The socket 4 of the embodiment is adapted for use with hexagonal nuts.

The reaction force receiving shaft 32 is provided with a reaction force receiving member 5 projecting in a direction orthogonal to the axis of the shaft 32.

The motor 2 of the embodiment is a brushless DC motor. As is already known, the brushless DC motor 2 has a drive circuit 21.

The handle 11 is provided with an operation switch (trigger) 6, rotation direction change switch 61 and controller 7.

Only while being pulled with the finger, the operation switch 6 holds the motor 2 energized.

The rotation direction change switch 61 is used for changing the direction of rotation of the motor 2 when the nut N is loosened or when tightening up a nut which is reversely threaded.

When detecting means 70 detects the tightening of the nut N by the rotation of the tightening socket 4, the controller 7 operates to momentarily reverse the rotation of the motor 2 (reversely rotate the motor for a moment) with a slight delay after the detection of completion of the tightening, with the operation switch 6 in the pulled state (for energization).

The detecting means 70 of the embodiment produces a detection signal upon the value of current to the motor 2 reaching a specified level. It is well known that the value of torque for tightening the nut N is substantially in proportion to the value of current to the motor 2, and it is conventional practice to detect the nut tightening torque from the current value.

The handle 11 of the tightening device is provided with a torque setting dial 70*a*, by which the device can be set to an optimum tightening torque corresponding to the nominal diameter of the nut to be tightened up.

Figure 4:
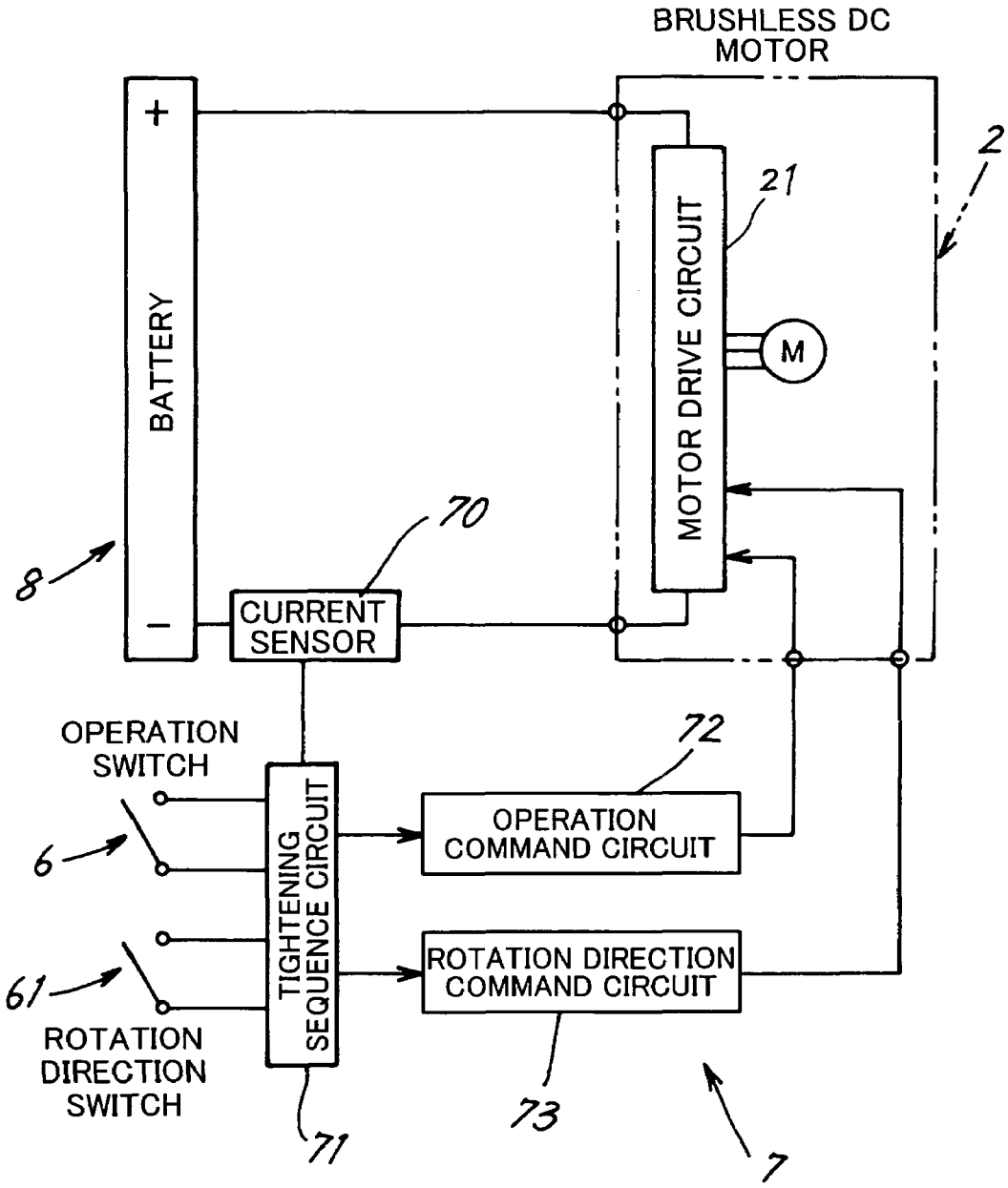
FIG. 4 is a block diagram of motor control.
Figure 5:
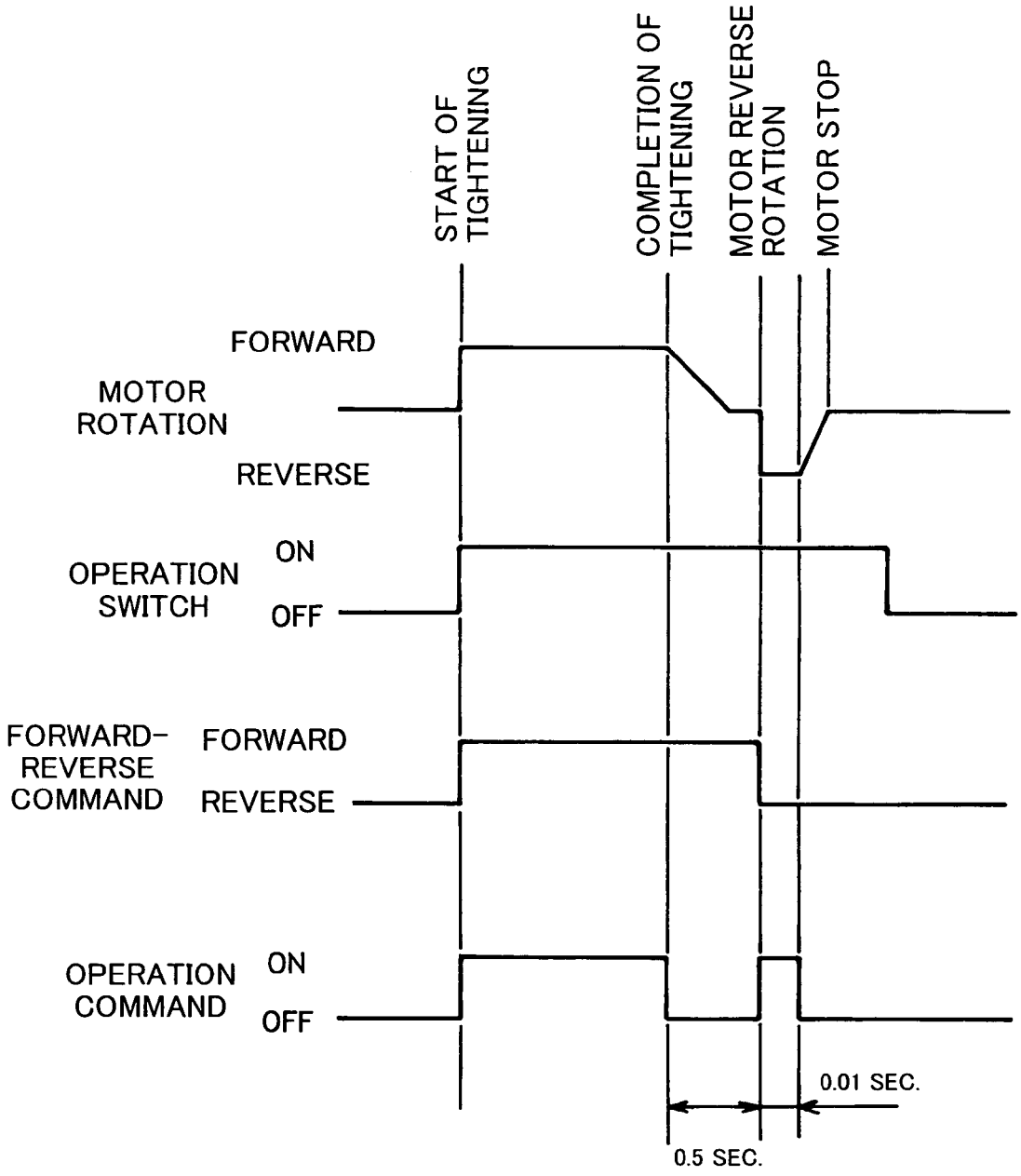
FIG. 5 is a timing chart of forward-reverse rotation changeover of the bolt-nut tightening device.

With reference to FIG. 4, the controller 7 comprises a tightening sequence circuit 71, and an operation command circuit 72 and a rotation direction command circuit 73 each adapted to feed a signal to the drive circuit of the brushless DC motor 2 in response to a command from the sequence circuit 71.

The tightening sequence circuit 71 has a digital timer (not shown) and is capable of delaying the transmission of a signal to the operation command circuit 72 by a set period of time and setting the duration of reverse rotation of the motor 2.

The time delay in transmitting the signal is a period of time required for the motor 2 in inertial rotation to slow down to such a speed that will not be objectionable to reverse the rotation of the motor 2 after the deenergization of the motor 2. It is desired that the time delay be within one second which is a period of time to be elapsed after the completion of tightening until the reverse rotation of the motor 2 without causing the worker to feel the delay as too great a retardation. The time delay of the embodiment is 0.5 second.

If the reverse rotation of the motor 2 requires 2 to 3 seconds after the completion of tightening, the delay will feel somewhat great but is still acceptable for actual use. When not smaller than 3 seconds, the delay feels too great and will lead to a lower tightening work efficiency.

The duration of reverse rotation of the motor 2 (stated precisely, the duration of energization of the motor 2 toward the direction of reverse rotation) is 0.01 second according to the embodiment; the motor 2 needs only to be reversely rotated for such a short period of time that will relieve the tightening device of the elastic deformation involved in the completion of tightening and that will not permit the nut N as tightened up to loosen.

The operation switch 6 and the rotation direction change switch 61 are coupled to the tightening sequence circuit 71.

When the operation switch 6 is pulled with the socket 4 in engagement with the nut N, the socket rotates forward, rotating the nut toward the tightening direction. The reaction force receiving member 5 comes into contact with a nut or like projection M in the vicinity of the nut N for the projection M to receive the reaction force of tightening.

When the nut N is tightened up to predetermined tightening torque, the detecting means 70 feeds a signal to the tightening sequence circuit 71 to deenergize the motor 2.

The reaction force receiving member 5 of the tightening device is in bearing contact with the projection M, preventing the device from rotating in a direction opposite to the tightening direction.

A motor reverse rotation command and an operation command are sent to the motor 2, 0.5 second after the deenergization of the motor 2, the motor 2 reversely rotates for a moment, and the motor 2 is deenergized again.

The reverse rotation of the motor 2 releases the tightening device 5 including the reaction force receiving member 5 from the elastic deformation due to the propping action of the member 5, nullifying the propping action of the reaction force receiving member 5.

The tightening socket 4 can be removed from the nut N without any resistance by pulling the tightening device axially of the nut N.

The operation switch 6 remains pulled after the start of the nut tightening operation until the motor 2 is brought out of rotation, hence no need for cumbersome switch manipulation.

Since the motor reversely rotates 0.5 second after the completion of tightening, a sequence of operations is completed in a moment without arousing any sense of waiting.

The brushless DC motor 2 has the drive circuit 21 incorporated therein, necessitates no additional switch circuit comprising a relay circuit or transistor circuit for reverse rotation control and therefore serves to make the controller 7 compact. For this reason, the present invention can be embodied favorably into a hand-held tightening device provided with a battery.

Because the brushless DC motor 21 is easy to control, the rotational speed of the motor for tightening and the reverse rotation speed thereof can be altered as required.

Figure 6:
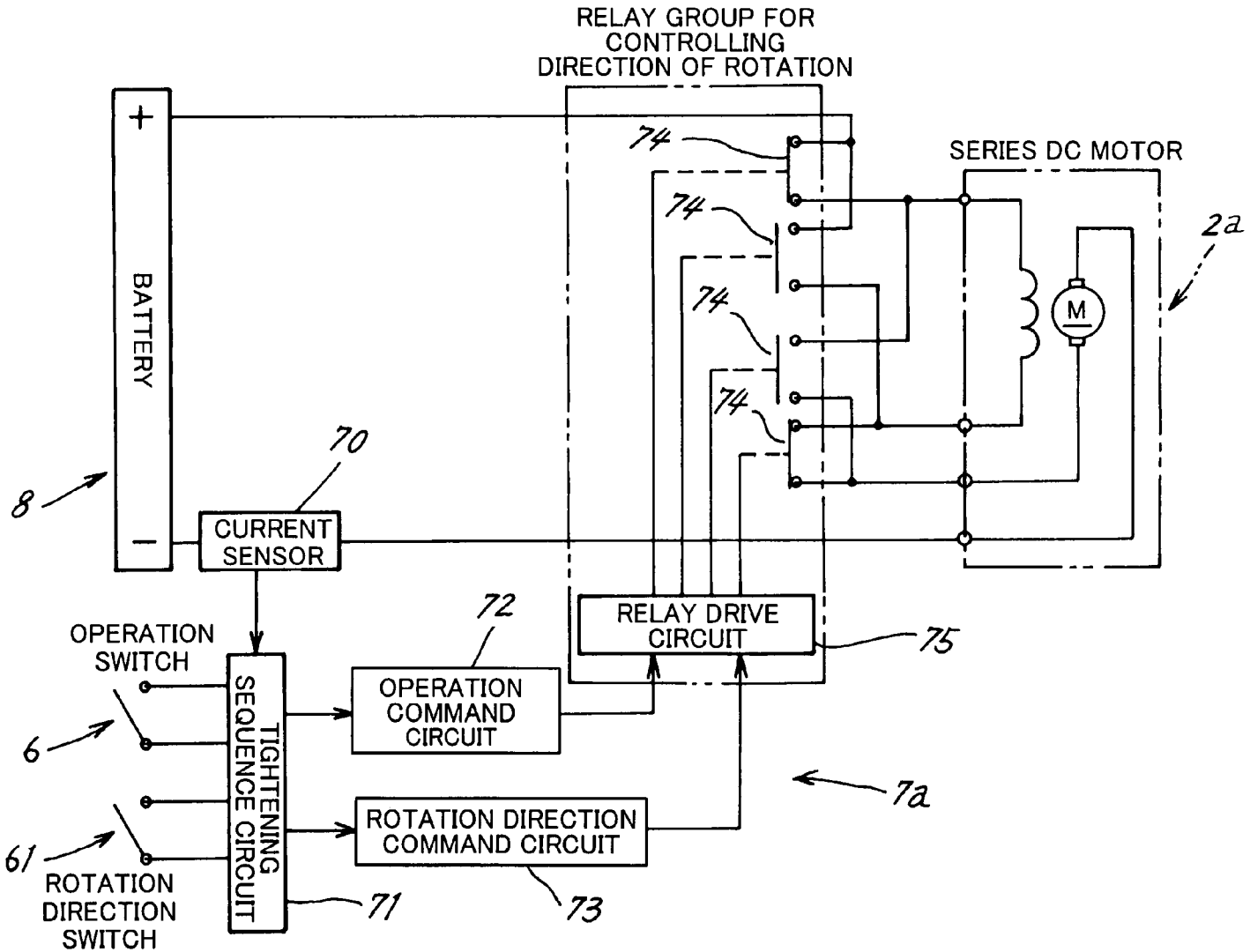
FIG. 6 is a block diagram of other embodiment wherein a group of relays are used for motor control.

FIG. 6 shows an embodiment of controller 7*a* comprising a series DC motor 2*a* which is increased in power even at a low speed.

The controller 7*a* comprises four electromagnetic relays 74 for changing the flow of current through the motor 2*a* to a reverse direction and a relay drive circuit 75 for controlling the relays, in addition to the components already described, i.e., the tightening completion detecting means 70, tightening sequence circuit 71, operation command circuit 72 and rotation direction command circuit 73. In this case, the four relays 74 are bulky to make the entire controller large-sized, so that the controller is not suitable for hand-held tightening devices.

Figure 7:
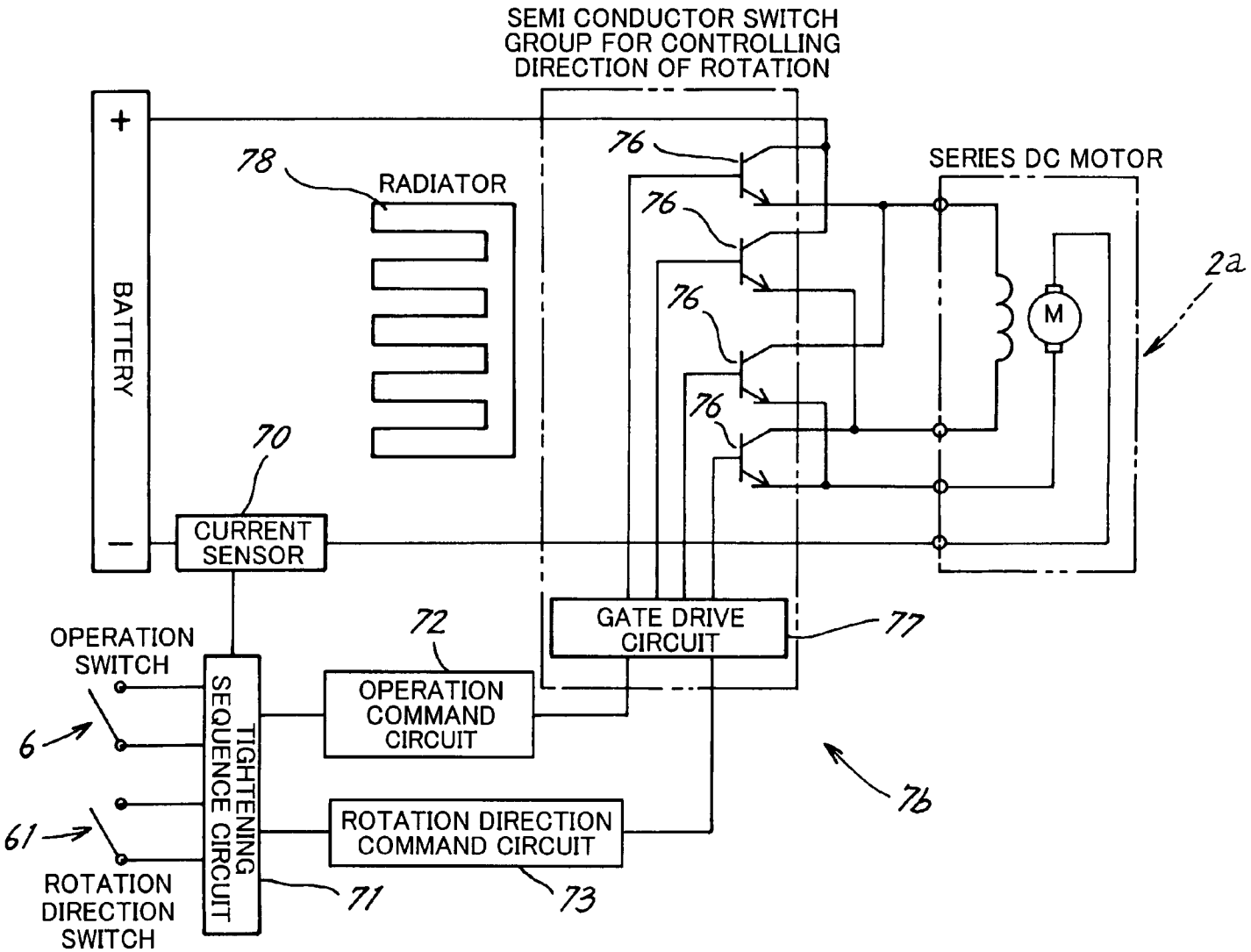
FIG. 7 is a block diagram of other embodiment wherein a group of semiconductor switches are used for motor control.

FIG. 7 shows an embodiment wherein four semiconductor switches (transistors) 76 are used for rotating a series DC motor 2*a* forward and reversely.

A controller 7*b* comprises four semiconductor switches 76 for changing the flow of current through the motor 2*a* to a reverse direction, a gate drive circuit 77 for controlling these switches and a radiator 78, in addition to the components already described, i.e., the tightening completion detecting means 70, tightening sequence circuit 71, operation command circuit 72 and rotation direction command circuit 73. In this case, the radiator 78 is bulky to make the controller 7*b* large-sized, so that the controller is not suitable for hand-held tightening devices.

The embodiments described above are intended to illustrate the present invention and should not be construed as limiting the invention as set forth in the appended claims or reducing the scope thereof. The device of the invention is not limited to the above embodiments in construction but can of course be modified variously within the technical scope described in the claims.

For example, although the tightening socket 4 of the embodiment is adapted for use with hexagonal nuts, the socket is not so limited. When the socket 4 has a cavity or a polygonal rod engageable with the bolt or nut to be tightened, for example, if the socket 4 has a projecting hexagonal rod engageable in a hexagon-shaped socket head of a bolt, the socket corresponds to the socket of the tightening device of the invention.

What is claimed is:

1. A bolt or nut tightening device having a tightening socket engageable with the bolt or nut to be tightened and operatively associated with a motor through a speed reduction mechanism, said tightening device comprising:

a reaction force receiving member adapted to be brought into contact with a projection positioned in the vicinity of the bolt or nut to be tightened and for receiving a reaction force of tightening when brought into contact with the projection during tightening operation, detecting means for detecting the completion of tightening of the bolt or nut;

a controller coupled to the motor, and operable to deenergize the motor in response to a tightening completion signal from the detecting means and to reversely rotate the motor only for a moment upon lapse of a predetermined period of time taken for inertial rotation of the motor to reduce to an extent neglectable for the reverse rotation of the motor after the deenergization; and said reaction force of tightening, which has been received by the reaction force receiving member, being released by the reverse rotation of the motor only for a moment after the deenergization thereof when the controller receives the tightening completion signal from the detecting means.

2. The tightening device according to claim 1 wherein the motor is a brushless DC motor.

3. The tightening device according to claim 2 wherein the time delay from the deenergization of the motor until the motor is reversely rotated is within 3 seconds.

4. The tightening device according to claim 3 which has a battery installed therein for driving the motor.

5. The tightening device according to claim 2 which has a battery installed therein for driving the motor.

6. The tightening device according to claim 1 wherein the time delay from the deenergization of the motor until the motor is reversely rotated is within 3 seconds.

7. The tightening device according to claim 6 which has a battery installed therein for driving the motor.

8. The tightening device according to claim 1 which has a battery installed therein for driving the motor.

* * * * *

UNITED STATES PATENT AND TRADEMARK OFFICE

CERTIFICATE OF CORRECTION

PATENT NO. : 7,011,000 B2
APPLICATION NO. : 11/156803
DATED : March 14, 2006
INVENTOR(S) : Toshihiko Kushida et al.

It is certified that error appears in the above-identified patent and that said Letters Patent is hereby corrected as shown below:

Col. 6, line 33, “claim 2” should read --claim 1--.

Signed and Sealed this

Fourth Day of July, 2006

JON W. DUDAS
*Director of the United States Patent and Trademark Office*